US006892507B1

(12) United States Patent
Pease

(10) Patent No.: US 6,892,507 B1
(45) Date of Patent: May 17, 2005

(54) INSULATED PANEL FOR COMMERCIAL OR RESIDENTIAL CONSTRUCTION AND METHOD FOR ITS MANUFACTURE

(75) Inventor: Tyler E. Pease, Plymouth, WI (US)

(73) Assignee: Plymouth Foam Incorporated, Plymouth, WI (US)

( * ) Notice: Subject to any disclaimer, the term of this patent is extended or adjusted under 35 U.S.C. 154(b) by 374 days.

(21) Appl. No.: 09/649,692

(22) Filed: Aug. 28, 2000

(51) Int. Cl.[7] ..... E04C 2/34

(52) U.S. Cl. ..... 52/794.1; 52/269; 52/271; 52/284; 52/309.2; 52/309.7; 52/309.11; 52/309.16; 52/407.3; 52/746.11; 52/787.11

(58) Field of Search ..... 52/309.1, 309.4, 52/309.9, 796.1, 796.4

(56) References Cited

U.S. PATENT DOCUMENTS

| | | | | | |
|---|---|---|---|---|---|
| 3,313,073 | A | | 4/1967 | Mathews | |
| 3,401,494 | A | | 9/1968 | Anderson | |
| 3,484,331 | A | | 12/1969 | Betz | |
| 3,729,880 | A | * | 5/1973 | Eliason | 52/232 |
| 3,791,912 | A | | 2/1974 | Allard | |
| 4,443,988 | A | * | 4/1984 | Coutu, Sr. | 52/309.9 |
| 4,480,416 | A | | 11/1984 | Judkins et al. | |
| 4,641,468 | A | | 2/1987 | Slater | |
| 4,641,469 | A | * | 2/1987 | Wood | 52/309.12 |
| 4,653,246 | A | | 3/1987 | Hepler | |
| 4,712,352 | A | * | 12/1987 | Low | 52/809 |
| 4,832,308 | A | | 5/1989 | Slonimsky et al. | |
| 4,841,710 | A | | 6/1989 | Considine | |
| 4,961,298 | A | | 10/1990 | Nogradi | |
| 5,058,333 | A | * | 10/1991 | Schwartz | 52/73 |
| 5,279,089 | A | | 1/1994 | Gulur | |
| 5,333,429 | A | | 8/1994 | Cretti | |
| 5,638,651 | A | * | 6/1997 | Ford | 52/309.9 |
| 5,758,464 | A | | 6/1998 | Hatton | |
| 5,799,462 | A | | 9/1998 | McKinney | |
| 5,842,276 | A | | 12/1998 | Asher et al. | |
| 5,893,248 | A | | 4/1999 | Beliveau | |
| 5,927,032 | A | | 7/1999 | Record | |
| 6,205,729 | B1 | * | 3/2001 | Porter | 52/309.7 |
| 6,209,284 | B1 | * | 4/2001 | Porter | 52/794.1 |
| 6,269,608 | B1 | * | 8/2001 | Porter | 52/794.1 |
| 6,279,284 | B1 | * | 8/2001 | Moras | 52/408 |
| 6,308,491 | B1 | | 10/2001 | Porter | |
| 6,408,594 | B1 | | 6/2002 | Porter | |

OTHER PUBLICATIONS

Gold-Wall Insulating System, Plymouth Foam Incorporated, Brochue (2 sided).

* cited by examiner

*Primary Examiner*—Carl D. Friedman
*Assistant Examiner*—Yvonne M. Horton
(74) *Attorney, Agent, or Firm*—Reinhart Boerner Van Deuren s.c.

(57) ABSTRACT

A method and apparatus for making an rigid foam insulating panel is disclosed. The panel includes an rigid foam sheet with a plurality of grooves or recesses in which reinforcing strips are placed. Both sides of the sub-assembly are covered with a reinforcing sheet made of plastic, paper, foil, or a combination thereof. These reinforcing sheets are bonded to the surface of the rigid foam sheet and provide structural support to the sheet, as well as retaining the reinforcing strips in place. They also provide a vapor barrier on both sides of the sheet to prevent the migration of moisture through the sheet toward the wall covering, which will typically be attached to the side of the sheet in which the reinforcing strips are inserted.

18 Claims, 3 Drawing Sheets

INSULATED PANEL FOR COMMERCIAL OR RESIDENTIAL CONSTRUCTION AND METHOD FOR ITS MANUFACTURE

FIELD OF THE INVENTION

The invention relates to insulation and construction devices. More particularly, it relates to the design and manufacture of rigid foam insulating panels.

BACKGROUND OF THE INVENTION

Rigid foam panels have been in wide use since the oil crisis of the early 1970's. Whether for exterior or interior use, rigid foam panels have provided an additional layer of insulation for houses and commercial buildings that, before the energy crisis, were often uninsulated, or insulated with fiberglass batting.

As with any new technology, rigid foam panels have been refined over the years. Originally, the panels were used as a replacement for fiberglass batting, and were cut to fit between studs. Later, sheets of rigid foam were used on the sides of houses being remodeled to add additional insulation to the exterior walls.

One continuing problem with the use of rigid foam panels has been their fragility as compared to other building materials, such as wood, steel, fiberglass and the like. The panels have limited tensile strength, and therefore cannot be used by themselves to support a great deal of weight on small connectors, such as nails and screws. Furthermore, the forces needed to attach nails and screws to a wall or ceiling of a house or commercial building when doing original construction or repair can quite easily damage the foam panels during installation.

When foam panels are used to form an insulated sheath around a wall that is being constructed, remodeled, or repaired, some of the most difficult issues are how to attach the foam panels. Since they are easily crushed, they cannot be used as an outer surface covering by themselves, or with a coat of paint, for example. As a result, some environmentally hardened wall covering must be applied over them, such as shingles, shakes, wallboard, and wood or other paneling.

When rigid foam insulation is applied it must therefore permit or provide for an additional layer to be attached to it, or at least be in contact with its outer surface. This problem is not a trivial one to solve, especially for interior walls in which another relatively fragile material, gypsum board, is attached. One cannot easily, and in many cases may not wish to attach the layer of wall covering directly to the wall or studs behind the rigid foam paneling. For example, when attaching interior wall covering to a concrete wall, particularly an exterior concrete wall, it is especially bad to have fasteners such as nails or screws penetrating the wall-covering passing through the rigid foam layer, and being embedded in the concrete wall. Such fasteners provide a simple channel for heat loss and for vapor or water penetration to the outer surface of the wall covering.

My co-pending application entitled "An Insulated Concrete Wall System And Method For Its Manufacture", filed contemporaneously with this application, describes a concrete wall system using the rigid foam panel described herein, and is incorporated by reference in this application for methods of using the panel, ways of constructing the panel, the structure and features of the panel, and all other teachings.

Another disadvantage to plain rigid foam sheets is their tendency to obscure the location of appropriate hanging points for the wall coverings that are subsequently attached through them to a wall. For example, once a complete sheet of rigid foam is attached to a wall, the trusses, and framing to which they were attached is completely covered up. When the subsequent layer of wall covering, such as siding or wallboard is attached, it is difficult, if not impossible to identify the location of the studs or trusses to which the foam was attached, and to which the wall covering must be attached as well. The only way to identify the location of the studs is with such tools as "stud finders", special electronic devices that can be waved in front of the wallboard to find the location of a good mounting point for the wall covering, such as the underlying studs or trusses. These devices are notoriously unreliable, sensing as they do, the presence of a stud by capacitive or inductive means. In addition, their use requires a separate hand to move the stud finder back and forth across the front of the wall covering until a "beep" is heard or a small red light flashes. All of this happens because the rigid foam covers up the mounting locations for mounting the subsequent wall-covering layer.

What is needed is a modified rigid foam panel and an efficient method of manufacturing it that avoids some, if not all of these problems (depending upon the embodiment). It is an object of this application to provide such a panel.

SUMMARY OF THE INVENTION

In accordance with the first embodiment of the invention, an insulated wall panel is provided including a rigid foam sheet with first and second planar sides and having first and second grooves extending substantially the full length of the sheet in a substantially parallel orientation in the first side of the sheet, a first reinforcing strip having a length, a top and a bottom, with the bottom being disposed in the first groove and the top facing outwardly away from the first groove, wherein the first strip extends substantially the full length of the sheet, a second reinforcing strip having a length, a top and a bottom with the bottom being disposed in the second groove and the top facing outwardly away from the second groove, wherein the second strip extends substantially the full length of the sheet, a first thin reinforcing layer bonded to the first planar side of the rigid foam sheet, and extending across the top of the first and second grooves, and a second thin reinforcing layer bonded to the second planar side of the sheet and extending across substantially an entire surface of the second planar side. The bottoms of the first and second strips may have two downwardly extending flanges that are oriented substantially perpendicular to the first planar side. The top of the first and second reinforcing strips may be mechanically textured over the length of the first and second strips to provide an improved gripping surface for drills and self-tapping or fine-threaded wallboard screws. The top of the first and second reinforcing strips may have a plurality of holes spaced apart at predetermined intervals along the length of the first and second reinforcing strips. The top of the first and second reinforcing strips may have a plurality of slots spaced apart at predetermined intervals along the length of the first and second reinforcing strips. The first reinforcing layer may be bonded to the rigid foam sheet to enclose the first and second reinforcing strips and to define a first vapor barrier across substantially the entire first side of the sheet. The second reinforcing layer may be bonded to the rigid foam sheet to define a second vapor barrier across substantially the entire second side of the rigid foam sheet. The first and second reinforcing layers may have a tensile strength at least 100 times as great as the tensile strength of the rigid foam sheet. A first portion of the first reinforcing layer may extend across the top of the first reinforcing strip and be placed in tension when the panel is bent away from the first reinforcing strip before the foam sheet will fracture at the first groove. A second portion of the first reinforcing layer may extend across the top of the second reinforcing strip and may be placed in tension when the panel is bent away from the second reinforcing strip before the rigid foam sheet will fracture at the second groove.

In accordance with a second embodiment of the invention, a method of manufacturing an insulated wall panel is provided that includes the steps of creating a foam block having first and second opposing sides, cutting the foam block to form a plurality of stacked individual foam sheets having first and second sides and a plurality of parallel recesses in the first side, inserting a reinforcing strip having a top and a bottom into each of the plurality of recesses in each of the plurality of sheets, covering the tops of each of the reinforcing strips with a first thin reinforcing layer, and bonding the first reinforcing layer to the first side of each of the rigid foam sheets. The method may also include the step of bonding a second reinforcing layer to the second side of each of the rigid foam sheets. The step of cutting the foam block may include the steps of drawing a hot wire frame of substantially equally spaced parallel hot wires through the block from the first side to the second opposing side of the block, and simultaneously forming each of the plurality of grooves in the block with each of the hot wires in the hot wire frame, and completing a path through the block by substantially simultaneously separating the block into a plurality of sheets.

The step of bonding the first reinforcing layer may include at least one of the following steps: (a) applying adhesive to the first side of each of the plurality of sheets and subsequently rolling the first reinforcing layer onto the first side; (b) applying adhesive to the first reinforcing layer and subsequently rolling the first reinforcing layer onto the first sides of each of the foam sheets, and (c) rolling the first reinforcing layer onto the first sides of the foam sheets and subsequently heating the first reinforcing layer to form a thermal bond between the first sides of the foam sheets and the first layer. The method may include the step of orienting the foam sheet with respect to a means for trimming each sheet such that there is a predetermined distance between the means for trimming and the reinforcing strips, and trimming an edge of the foam sheet.

In accordance with a third embodiment of the invention, a method of manufacturing an insulated foam panel is provide that includes the steps of continuous foaming a liquid matrix of expanding foam precursor, channeling the liquid matrix out through a nozzle, capturing the liquid matrix between two parallel and advancing thin sheets of reinforcing material, inserting a plurality of continuous webs of reinforcing strip between the two sheets of reinforcing material, maintaining the sheets in a substantially parallel spaced apart orientation as they advance over a distance sufficient to permit the liquid matrix to expand, fill substantially an entire void between the two sheets, and harden in the form of a continuously moving ribbon of insulated panel, and repeatedly and successively cutting the moving ribbon into a plurality of individual insulating panels having a cut edge substantially perpendicular to the direction of advancement. The method may include the steps of unrolling a plurality of ribbons of reinforcing material at substantially the same linear rate as the first and second sheets advance, and roll forming the plurality of unrolled ribbons into the plurality of continuous webs of reinforcing strip. The method may include the step of continuously trimming lateral opposed edges of the ribbon of insulated paneling as the ribbon advances and prior to the step of spacing the plurality of continuous webs of reinforcing strips a first predetermined distance apart. The steps of maintaining the sheets may include the step of simultaneously maintain the plurality of continuous webs of reinforcing strips at the first predetermined distance apart.

DETAILED DESCRIPTION OF THE PREFERRED EMBODIMENT

Figure 1:
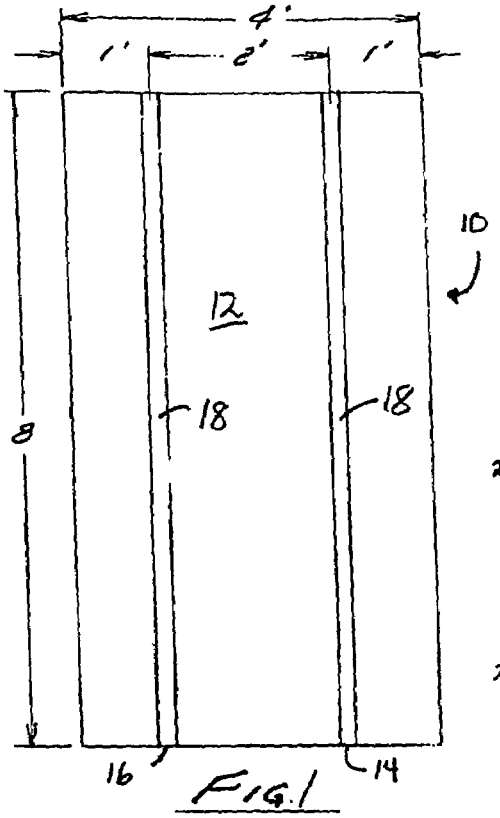
FIG. 1 shows a plan view of an insulated panel in accordance with the present invention.
Figure 2:
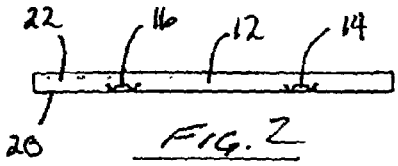
FIG. 2 shows an end view of the panel in FIG. 1.

Referring now to FIGS. 1 and 2, an insulated foam panel 10 is shown that includes an rigid foam sheet 12 having two grooves 14, 16 into which two reinforcing strips 18 are disposed. The panel is preferably four feet wide by eight feet long (4'× 8') and between one and three inches (1"–3") in thickness. The two reinforcing strips are preferably equidistantly spaced from the center of the panel two feet (2') apart leaving a one-foot (1') margin on either side. In this manner, when the panels are placed adjacent to each other by abutting their edges in a checkerboard arrangement, a continuous expanse of equidistantly spaced reinforcing strips on two foot centers will be provided.

On the outer surfaces of panel 10 are two thin reinforcing sheets 20 and 22. The first of these, sheet 20, extends completely across the side of the rigid foam sheet proximate to the reinforcing strips. The second of these, sheet 22, extends completely across and covers the entire surface of the opposing side of the sheet.

The reinforcing layers or sheets are preferably made of plastic, paper, foil or a combination thereof, preferably in a composite film form, if more than one material is used. The preferred plastic for the sheets is polyolefin or polyester.

Rigid foam sheet 12 may be formed of any of a variety of rigid foam materials. These materials may be thermoplastic or thermosetting foams. Preferred foam materials include polystyrene, polyisocyanurate and polyurethane. The sheet, depending on application, has a thickness of between one and three inches with a thermal resistance ("R") value of between 3 and 8 per inch of thickness.

Figure 8:
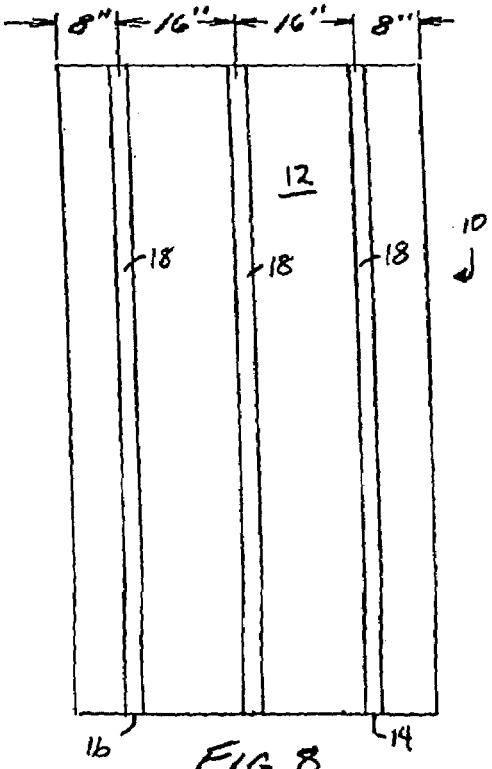
FIG. 8 illustrates an alternative arrangement of reinforcing strips for the insulated panel of FIG. 1.

Reinforcing strips 18 extend substantially the entire length of the panel in a parallel side-by-side arrangement. As shown in FIG. 1, two strips are preferably provided. Alternatively, three strips (or more) can be provided as shown in FIG. 8.

The strips preferably have a top surface 19 that is substantially coplanar with the surface of the rigid foam sheet. In this manner, when reinforcing sheets 20 and 22 are bonded to the surface of rigid foam sheet 12, the top surfaces 19 of the reinforcing strips (i.e., the outwardly facing surface of the reinforcing strips) will be adjacent to the reinforcing sheet and at substantially the same level, applied to the outer surface without lifting it up away from the surface of the sheets. With this arrangement, when subsequent layers of material, such as gypsum board, are attached to the reinforcing strip, the inner panel-facing surface of these wallboards will be flush with both the foam sheet and with the tops of the reinforcing strips.

Figure 3:
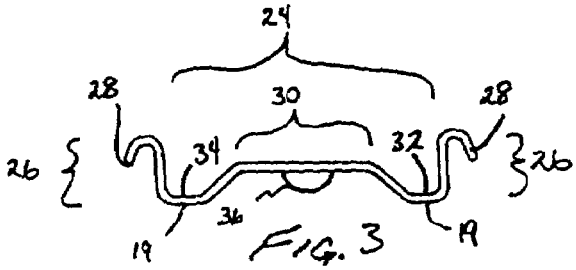
FIG. 3 is an end view of the reinforcing strip of the panel in FIGS. 1 and 2.
Figure 4:
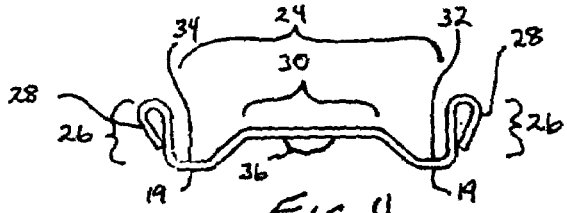
FIG. 4 is an end view of an alternative reinforcing strip for the panel of FIGS. 1 and 2.

Referring now to FIGS. 3 and 4, reinforcing strips 18 may have several different cross-sectional profiles. FIGS. 3 and 4 represent just two possible cross-sectional profiles of the strips. The embodiments of both FIGS. 3 and 4 have a central web portion 24 with two outwardly extending fins 26. As shown in FIG. 3, these fins 26 can be rolled at their free ends to provide gripping edges 28 that can be inserted into rigid foam sheet 12 to hold reinforcing strips 18 into position. Central web 24 of the strips preferably has a recessed central portion 30 that extends substantially parallel to and slightly below (as shown in FIG. 2) the surface of the insulated panel 10. On either side of this recessed central portion are two non-recessed portions 32 and 34 that define the topmost surface of the reinforcing strips. Portions 32 and 34 are preferably disposed coplanar with the surface of rigid foam sheet 12. By recessing a portion of the web of reinforcing strips 18, the head of a fastener, 36 used to attach the panel to a wall can be completely recessed below the nominal surface of insulated panel 10.

Figure 5:
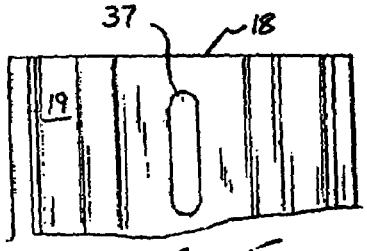
FIG. 5 is a fragmentary plan view of the reinforcing strips of FIGS. 1–4 showing an elongated slot construction.
Figure 6:
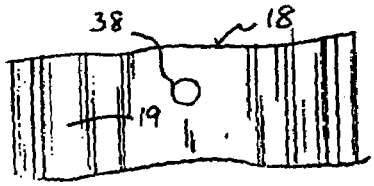
FIG. 6 is a fragmentary plan view of the reinforcing strip of FIGS. 1–4 showing a mounting hole.
Figure 7:
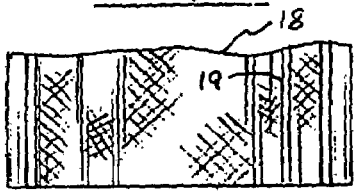
FIG. 7 is a fragmentary plan view of the reinforcing strip of FIGS. 1–4.

Referring now to FIGS. 5–7, reinforcing strips 18 can be provided with a variety of surface finishes and fastening mounts. As shown in FIG. 5, elongate slots 37 extending substantially parallel to the length of the strips can be disposed in a spaced apart arrangement over the length of the strip. As shown in FIG. 6, holes 38 can similarly be provided along the length of the strip. As shown in FIG. 7, the top surface of reinforcing strips 18 can be textured, such as by knurling, roll-forming, punching or stamping. This textured surface provides surface irregularities that reduce the tendency of drills or self-tapping screws to wander when they are drilled through reinforcing strip 18.

There are several ways of making insulated panels in accordance with this invention. FIGS. 9–11 and 13 show one method for making insulated panel 10, and FIG. 12 shows another preferred method.

Figure 10:
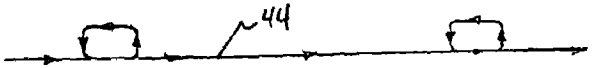
FIG. 10 illustrates the path followed by a hot wire in order to make the individual sheets from the foam block of FIG. 9.
Figure 9:
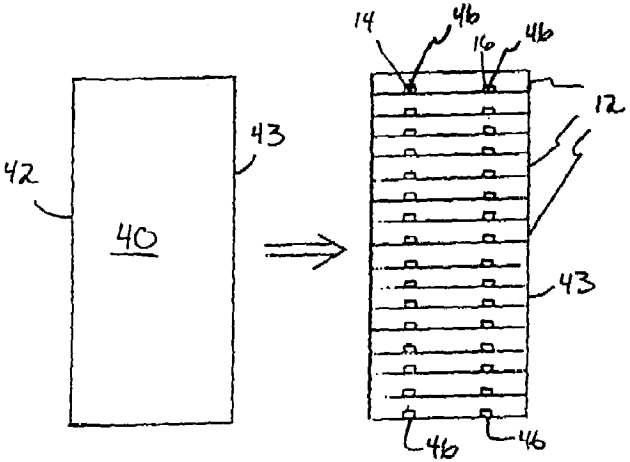
FIG. 9 illustrates one method of forming a plurality of insulating foam sheets from a solid foam block.

Referring now to FIG. 9, a foam block 40, typically having outer dimensions on the order of three feet by four feet by eight feet (3' ×4' ×8') is cut into a stack of rigid foam sheets using a hot wire frame. Each of the joints between the stacked foam sheets 12 shown in FIG. 9 is formed by a hot wire or ribbon following the path shown in FIG. 10. These wires, in order to form a plurality of insulated foam sheets having a constant thickness, are about eight feet (8') long and are spaced equidistantly apart. Their spacing is preferably equal to the desired thickness of the rigid foam sheets. The wires are parallel to each other and lie in a plane. At their ends, they are attached to a frame that holds them in this orientation. The wires are heated and the frame is advanced until all the wires contact side 42 of block 40. The frame is translated through the block such that all the wires follow the path shown in FIG. 10, simultaneously forming the first grooves 14 in the partially separated block then returning to their original path 44 as the frame traverses block 40 until the second groove 16 is formed by the wires following path 44 as shown in FIG. 10. Once the second groove is formed, the wires again return to their original path 44 and continue until they all substantially simultaneously exit side 43 of the foam block 40 and each of the rigid foam sheets 12 are substantially simultaneously separated from each other.

When this cutting process is complete, a stack of individual foam sheets is produced as shown in FIG. 9. Each of the rigid foam sheets includes two long strips of rigid foam 46 that must be removed from each of the sheets as shown in FIG. 11.

While this is the preferred process, an alternative process could use the same frame of hot wires that travel along a straight line through block 40 to form a stack of sheets each sheet having two smooth opposing surfaces and no recesses 14 and 16. In this process, once the sheets have been formed, they can be separated and have their grooves 14, 16 formed individually and sequentially on each sheet. Preferably, two hot knives, ribbons, wires, rolls, or a milling cutter will be drawn down the length of each sheet 12 simultaneously forming the two grooves 14 and 16 starting at one end of each rigid foam sheet 12 and traveling the length of that sheet until the two groove-forming tools reach the other opposing end of the sheet in a single pass that forms both recesses simultaneously. The path followed by the tool making the recess is preferably parallel to the longitudinal extent of the recesses in this method.

Figure 11:
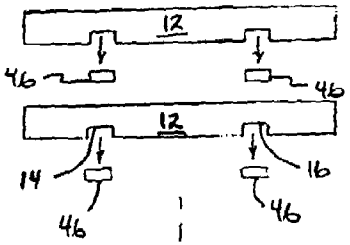
FIG. 11 illustrates the step of removing excess material from each of the grooves formed as shown in FIGS. 9 and 10.
Figure 12:
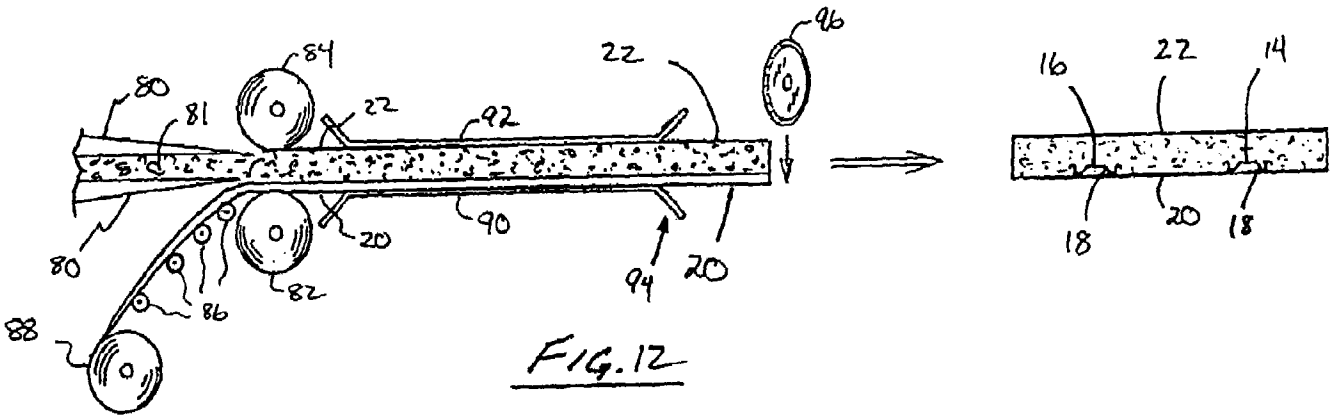
FIG. 12 illustrates a first process for assembling the insulated foam panel of the foregoing FIGURES.
Figure 13:
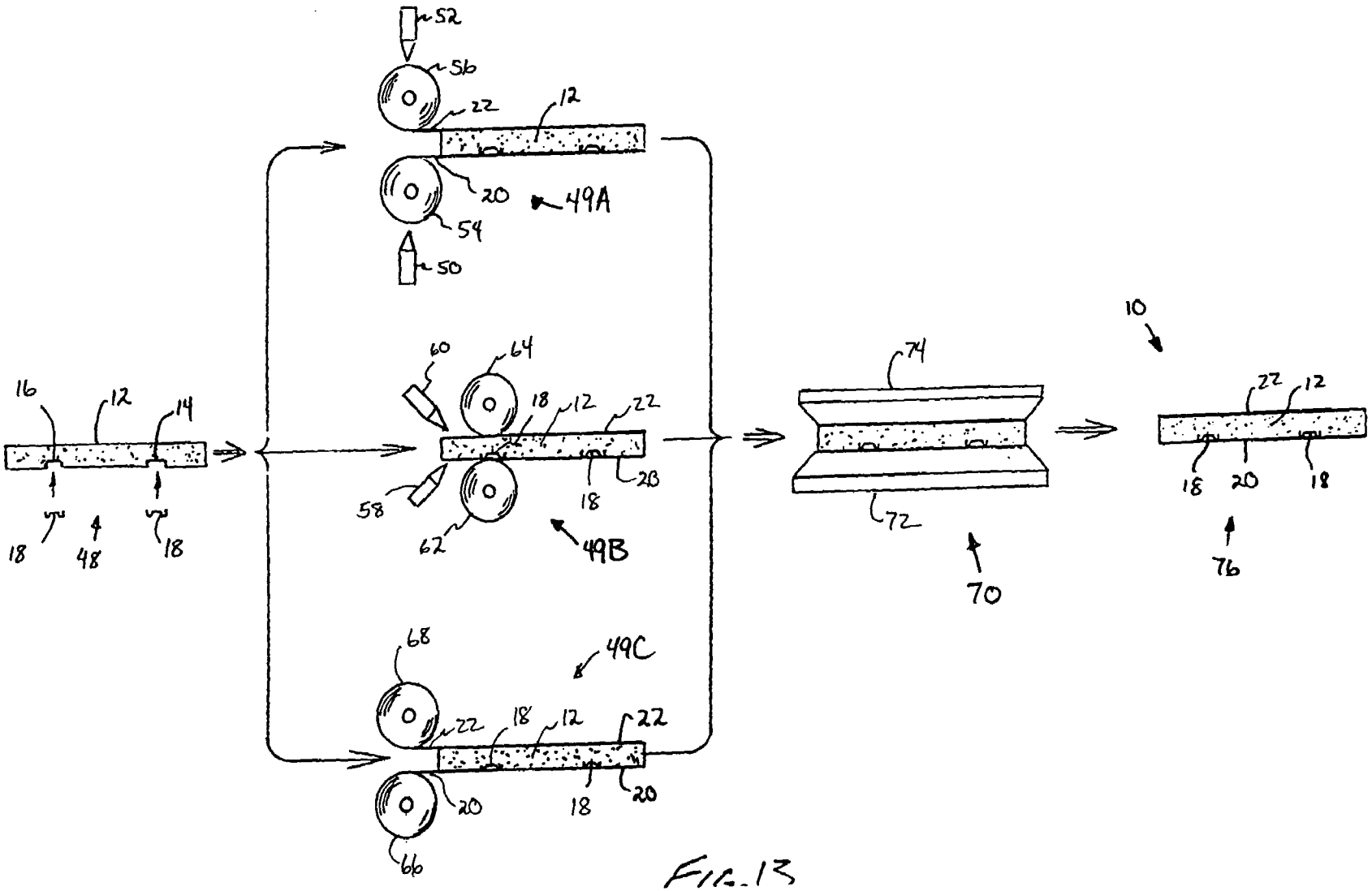
FIG. 13 illustrates an alternative process for forming the insulated foam panels of the preceding FIGURES.

FIG. 13 illustrates a continuation of the panel forming process that started in FIGS. 9–11. In FIG. 13, a panel is shown in various steps of its assembly and manufacture starting at the left and proceeding in the direction of the arrows to the right side of the FIGURE. In the center of the FIGURE are three alternative processes, 49A, 49B, 49C, each of which are suitable for applying the reinforcing sheets to the rigid foam sheet 12. In step 48, two reinforcing strips 18 are inserted into grooves 14, 16 in the rigid foam sheet 12. Once the strips are inserted into the sheet, the reinforcing sheets 20, 22 are applied to each side of the rigid foam sheet 12.

In step 49A, adhesive-dispensing nozzles 50, 52 apply adhesive to reinforcing sheet material being drawn off two rolls 54 and 56. Rigid foam sheet 12 with reinforcing strips 18 inserted is then moved between these rolls and the adhesive-coated reinforcing sheet material is unrolled and applied to the opposing surfaces of the rigid foam sheet 12.

In alternative step 49B, located in the center of FIG. 13, two adhesive dispensing nozzles 58, 60 apply an adhesive directly to both sides of the rigid foam sheet 12 itself, and reinforcing sheet material on two rolls 62, 64 is subsequently rolled onto the rigid foam sheet 12 as it moves rightward.

In step 49C, located at the bottom of FIG. 13, no adhesive is applied and the rigid foam sheet 12 is covered on both sides with the reinforcing sheet material that is held on rolls 66, 68.

In step 70, two heated rollers or sheets 72 and 74 are pressed against both sides of the sheet to either (a) cure the adhesive previously applied in steps 49A and 49B, or to (b) thermally bond reinforcing sheets 20, 22 to the rigid foam sheet 12 previously assembled in step 49C. Once this heating is complete, the completely assembled insulated foam panel 10 is removed as shown in step 76.

Nozzles 50, 52, 58 and 60 that are used to apply adhesives, preferably apply an even layer of adhesive across the entire face of either the reinforcing sheet 20, 22 or the rigid foam sheet 12 as shown in steps 49A and 49B. In this manner, the bond preferably extends across the entire interface between the reinforcing sheets 20, 22 and the rigid foam sheet 12.

In an alternative embodiment, any or all of the nozzles may apply glue to an intermediate roller that is thereby covered with glue. This intermediate roller will then transfer the glue to the rollers shown in the FIGURES by rolling contact.

The process shown in FIG. 13 illustrates the formation of the most complete and preferred embodiment of this invention. As noted above, there may be different numbers of reinforcing strips, not just two as shown in FIG. 13, that are inserted into the rigid foam sheet 12. In addition, one of the reinforcing sheets need not be applied.

Finally, although steps 49A–49B show adhesive applied to either both sides of the rigid foam sheet 12 (step 49B) or to both sheets of reinforcing sheet material (49A). It should be understood that these two processes can be combined, so that one side of the rigid foam sheet 12 is covered with an adhesive coated reinforcing sheet and the other side of the rigid foam sheet 12 has adhesive applied directly to it.

FIG. 12 shows a continuous process of forming insulating wall panels 10. In this embodiment, a nozzle 80 directs a flow of a liquid matrix 81 of expandable foam precursor such that it forms a thin, wide sheet, preferably on the order of four feet wide. The liquid matrix flows between two reinforcing sheets 20, 22 unrolled by rollers 82 and 84. A plurality of metallic reinforcing strips, such as those shown and described above, are roll-formed by rollers 86 from thin, flat sheet stock on roll 88 and are inserted adjacent to the top or the bottom (as shown here) of the liquid matrix. The sheets and the foam in between them as well as the reinforcing strips are advanced through the machine between two sheet supports 90, 92, each of which may be shoes, such as shown here, or an endless belt loop supported by rollers. These sheet supports constrain and support the liquid matrix as it cures to rigid foam. By varying the spacing of the sheet supports, insulated panels of several thicknesses may be made using the same machine.

Once the composite structure reaches the end 94 of the supports, the foam has cured and the panel is substantially rigid. This continuous sheet of paneling is then cut to discrete lengths by a flying cutter 96, disposed after the end 94 of the supports.

In an alternative embodiment, nozzles 80 can direct the flow of foam beads or pellets instead of a liquid matrix. In this alternative embodiment, sheets supported 90, 92 are preferably heated by steam to cause the beads or pellets to expand and bond to each other to form the foam core of the panel. An example of a machine illustrating this foam bead or pellet process for forming a sheet can be seen in U.S. Pat. Nos. 4,379,107 and 5,786,000.

While those skilled in the art may recognize other ways in which the present application may be useful, this application is not to be limited by the descriptions given above, but is to be limited solely by the scope of the claims that follow.

What is claimed is:

1. A method of manufacturing an insulated wall panel, comprising the steps of:

creating a rigid foam block having first and second opposing sides;

cutting the foam block to form a plurality of stacked individual foam sheets having first and second sides and a plurality of parallel recesses in the first side;

inserting a reinforcing strip having a top and a bottom into each of the plurality of recesses in each of the plurality of sheets;

covering the tops of each of the reinforcing strips with a first thin reinforcing layer;

bonding the first reinforcing layer to the first side of each of the foam sheets; and bonding a second reinforcing layer to the second side of each of the foam sheets;

wherein the step of cutting the foam block includes the steps of:

drawing a hotwire frame of substantially equally spaced parallel hot wires through the block from the first side to the second opposing side of the block;

simultaneously forming each of the plurality of grooves in the block with each of the hot wires in the of the hotwire frame; and completing a path through the block by substantially simultaneously separating the block into the plurality of sheets.

2. A method of manufacturing an insulated wall panel, comprising the steps of:

creating a rigid foam block having first, and second opposing sides;

cutting the foam block to form a plurality of stacked individual foam sheets having first and second sides and a plurality of parallel recesses in only the first side;

inserting a reinforcing strip having a top and a bottom into each of the plurality of recesses in each of the plurality of sheets, wherein the reinforcing strip has a surface finish including at least a mechanically textured top surface and a plurality of spaced apart holes, or a plurality of spaced apart slots configured to engage mechanical fasteners;

covering the tops of each of the reinforcing strips with a first thin reinforcing layer; and bonding the first reinforcing layer to the first side of each of the foam sheets;

wherein the step of bonding the first reinforcing layer includes at least one of the following steps:

(a) applying adhesive to the first side of each of the plurality of sheets and subsequently rolling the first reinforcing layer onto the first side;

(b) applying adhesive to the first reinforcing layer and subsequently rolling the first reinforcing layer onto the first sides of each of the foam sheets; and (c) rolling the first reinforcing layer onto the first sides of the foam sheets and subsequently heating the first reinforcing layer to form a thermal bond between the first sides of the foam sheets and the first layer.

3. A method of manufacturing an insulated wall panel, comprising the steps of:

creating a rigid foam block having first, and second opposing sides:

cutting the foam block to form a plurality of stacked individual foam sheets having first and second sides and a plurality of parallel recesses in only the first side;

inserting a reinforcing strip having a top and a bottom into each of the plurality of recesses in each of the plurality of sheets, wherein the reinforcing strip has a surface finish including at least a mechanically textured top surface and a plurality of spaced apart holes; or a plurality of spaced apart slots configured to engage mechanical fasteners;

covering the tops of each of the reinforcing strips with a first thin reinforcing layer;

bonding the first reinforcing layer to the first side of each of the foam sheets; and further comprising the steps of:

orienting the foam sheets with respect to a means for trimming each sheet such that there is a predetermined distance between the means for trimming and the reinforcing strips, and trimming an edge of the foam sheets.

4. A method of manufacturing an insulated foam panel, comprising the steps of:

forming a liquid matrix of expandable foam precursor;

channeling the liquid matrix out through a nozzle;

capturing the liquid matrix between two parallel and advancing thin sheets of reinforcing material;

inserting a plurality of continuous webs of reinforcing strip between the two sheets of reinforcing material;

maintaining the sheets in a substantially parallel, spaced-apart orientation as they advance over a distance sufficient to permit the liquid matrix to expand, fill substantially an entire void between the two sheets and harden in the form of a continuously moving ribbon of insulated paneling; and repeatedly and successively cutting the moving ribbon into a plurality of individual insulating panels having a cut edge substantially perpendicular to the direction of advancement.

5. The method of claim 4, further comprising the steps of:

unrolling a plurality of ribbons of reinforcing material at substantially the same linear rate as the first and second sheets advance; and roll-forming the plurality of unrolled ribbons into the plurality of continuous webs of reinforcing strip.

6. The method of claim 5, further comprising the step of:

continuously trimming lateral opposed edges of the ribbon of insulated paneling as the ribbon advances and prior to step of repeatedly and successively cutting.

7. The method of claim 5, wherein the step of inserting includes the steps of:

spacing the plurality of continuous webs of reinforcing strips a predetermined first distance apart.

8. The method of claim 5, wherein the steps of maintaining the sheets includes the step of:

simultaneously maintaining the plurality of continuous webs of reinforcing strips at the predetermined first distance apart.

9. An insulated wall panel, comprising:

a rigid foam sheet with first and second planar sides and having first and second grooves extending substantially the full length of the sheet in a substantially parallel orientation within only the first side of the sheet;

a first reinforcing strip having a length, a top and a bottom with the bottom being disposed in the first groove and the top facing outwardly away from the first groove, wherein the first strip extends substantially the full length of the sheet;

a second reinforcing strip having a length, a top and a bottom with the bottom being disposed in the second groove and the top facing outwardly away from the second groove, wherein the second strip extends substantially the full length of the sheet;

a first thin reinforcing layer bonded to the first planar side of the sheet, and extending across the top of the first and second grooves and substantially covering the entire first planar side of the sheet; and a second thin reinforcing layer bonded to the second planar side of the sheet and extending across substantially an entire surface of second planar side, wherein the bottoms of the first and second strips each have two downwardly extending flanges that are oriented substantially perpendicular to the first planar side, and further wherein the top of the first and second reinforcing strips are mechanically textured over the length of the first and second strips to provide an improved gripping surface for drills and self tapping screws, wherein the first and second reinforcing strips include a central recessed portion configured to receive and support the head of a fastener, and further comprising a plurality of fasteners coupled to the central recessed portion of both the first and second reinforcing strips.

10. The insulated wall panel of claim 9, wherein an outwardly facing surface of the first and second reinforcing strips is configured to guide the insertion of a fastener therethrough.

11. The insulated wall panel of claim 10, wherein the outwardly facing surface is configured with a surface texture that guides the insertion of a fastener therethrough.

12. The insulated wall panel of claim 10, wherein the outwardly facing surface is configured with apertures that guide the insertion of a fastener therethrough.

13. The insulated wall panel of claim 9, wherein lateral sides of the first and second reinforcing strips are spaced at least 6 inches away from the lateral edges of the rigid foam sheet.

14. The insulated wall panel of claim 13, wherein the first and second reinforcing strips are generally spaced 12 inches apart.

15. The insulated wall panel of claim 9, wherein lateral sides of the first and second reinforcing strips are spaced at least 8 inches away from the lateral edges of the rigid foam sheet.

16. The insulated wall panel of claim 15, wherein the first and second reinforcing strips are generally spaced 16 inches apart.

17. The insulated wall panel of claim 9, wherein the first and second reinforcing layers primarily consist of paper, foil or plastic film.

18. An insulated wall panel, comprising:

a rigid foam sheet with first and second planar sides and having first and second grooves extending substantially the full length of the sheet in a substantially parallel orientation in only the first side of the sheet and first and second opposing edges generally parallel to the first and second grooves;

a first reinforcing strip having a length, a top and a bottom with the bottom being disposed in the first groove and the top facing outwardly away from the first groove, wherein the first strip extends substantially the full length of the sheet and disposed in said sheet inwardly away from the first and second edges of the sheet;

a second reinforcing strip having a length, a top and a bottom with the bottom being disposed in the second groove and the top facing outwardly away from the second groove, wherein the second strip extends substantially the full length of the sheet and is disposed in said sheet inwardly away from the first and second edges of the sheet;

a first thin reinforcing layer bonded to the first planar side of the sheet, and extending across the top of the first and second grooves and substantially covering the entire first planar side of the sheet; and a second thin reinforcing layer bonded to the second planar side of the sheet and extending across substantially an entire surface of second planar side;

wherein the first and second reinforcing strips include a central recessed portion configured to receive and support the head of a fastener and two non recessed portions that flank the recessed portion and extending substantially the entire length of the respective first and second reinforcing strips, further comprising a plurality of headed fasteners each having a head that is supported in the recessed portion and a shank that extends through the recessed portion.

* * * * *